US008985400B2

(12) United States Patent
Swan et al.

(10) Patent No.: US 8,985,400 B2
(45) Date of Patent: Mar. 24, 2015

(54) MICRO PARTICLE FLOW FACILITATOR

(71) Applicant: Crystal-Mark, Inc., Glendale, CA (US)

(72) Inventors: Keith D. Swan, Sylmar, CA (US); Jawn P. Swan, Los Angeles, CA (US); William H. Stutz, Jr., Eagle Rock, CA (US)

(73) Assignee: Crystal-Mark, Inc., Glendale, CA (US)

( * ) Notice: Subject to any disclaimer, the term of this patent is extended or adjusted under 35 U.S.C. 154(b) by 0 days.

(21) Appl. No.: 14/156,959

(22) Filed: Jan. 16, 2014

(65) Prior Publication Data

US 2014/0326755 A1 Nov. 6, 2014

Related U.S. Application Data

(60) Provisional application No. 61/818,161, filed on May 1, 2013.

(51) Int. Cl.
*B65D 88/66* (2006.01)

(52) U.S. Cl.
CPC ..... *B65D 88/66* (2013.01)
USPC ..... 222/200; 222/196; 222/1; 222/400.5; 222/399; 366/124; 366/154.2; 406/75; 406/136; 406/137; 406/144; 406/146

(58) Field of Classification Search
USPC ..... 222/196, 200, 394, 399, 400.5, 409, 1; 366/106, 124, 154.2; 406/134, 136, 75, 406/137, 144, 146
See application file for complete search history.

(56) References Cited

U.S. PATENT DOCUMENTS

| | | | | |
|---|---|---|---|---|
| 2,048,139 | A | 7/1936 | Porteous | |
| 2,170,258 | A * | 8/1939 | Borch | 222/202 |
| 2,192,287 | A | 3/1940 | Goebels | |
| 2,696,049 | A | 12/1954 | Black | |
| 2,734,782 | A | 2/1956 | Galle | |
| 2,740,561 | A | 4/1956 | Coffman, Jr. | |
| 2,878,969 | A | 3/1959 | Griswold | |
| 3,337,094 | A * | 8/1967 | Houston | 222/196 |
| 3,407,972 | A | 10/1968 | Cymbalisty | |
| 3,432,208 | A | 3/1969 | Draper | |

(Continued)

FOREIGN PATENT DOCUMENTS

| | | | |
|---|---|---|---|
| JP | 09253401 | A | 9/1997 |
| JP | 2000280173 | A | 10/2000 |
| JP | 2003230562 | A | 8/2003 |

OTHER PUBLICATIONS

Office Action dated May 27, 2014 issued in U.S. Appl. No. 14/200,364.

(Continued)

*Primary Examiner* — Kevin P Shaver
*Assistant Examiner* — Nicholas J Weiss
(74) *Attorney, Agent, or Firm* — Leech Tishman Fuscaldo & Lampl

(57) ABSTRACT

A micro particle flow facilitator, includes: (a) a bourdon tube having a flexible duct capable of expanding and contracting in response to pulsations of a pressurized fluid, the duct being hollow, closed-ended and having an inlet port; and (b) a fluid pulsator for providing the pulsations of a pressurized fluid to the inlet port of the bourdon tube, the pulsator being in fluid-tight communication with the inlet port of the bourdon tube and having a fluid inlet port for connection to a source of pressurized fluid.

20 Claims, 4 Drawing Sheets

(56) References Cited

U.S. PATENT DOCUMENTS

| | | | | | |
|---|---|---|---|---|---|
| 3,525,445 | A | * | 8/1970 | Barger | 222/196 |
| 3,595,437 | A | | 7/1971 | Howard | |
| 4,176,767 | A | | 12/1979 | Franche | |
| 4,383,766 | A | * | 5/1983 | Eriksson | 366/106 |
| 4,416,568 | A | | 11/1983 | Anderson | |
| 4,472,091 | A | | 9/1984 | Callahan | |
| 4,502,819 | A | | 3/1985 | Fujii et al. | |
| 4,569,161 | A | | 2/1986 | Shipman | |
| 4,591,075 | A | * | 5/1986 | Eriksson | 222/195 |
| 4,733,503 | A | | 3/1988 | Gallant et al. | |
| 4,810,156 | A | | 3/1989 | Pendleton et al. | |
| 4,934,569 | A | * | 6/1990 | Womack et al. | 222/195 |
| 5,012,957 | A | | 5/1991 | Mihail | |
| 5,490,745 | A | | 2/1996 | Thiele et al. | |
| 6,079,911 | A | | 6/2000 | Wangermann et al. | |
| 6,083,001 | A | | 7/2000 | Deardon et al. | |
| 6,186,360 | B1 | | 2/2001 | Becker et al. | |
| 6,244,788 | B1 | | 6/2001 | Hernandez | |
| 6,283,680 | B1 | | 9/2001 | Vidal | |
| 6,708,851 | B2 | | 3/2004 | DaSilva | |
| 6,776,361 | B1 | | 8/2004 | Watanabe et al. | |
| 6,802,685 | B1 | | 10/2004 | Federhen | |
| 6,892,748 | B2 | | 5/2005 | Junier et al. | |
| 8,200,367 | B2 | | 6/2012 | Foley et al. | |
| 2002/0137005 | A1 | | 9/2002 | Cevey et al. | |
| 2003/0024955 | A1 | | 2/2003 | Maguire | |
| 2003/0131666 | A1 | | 7/2003 | Ewers et al. | |
| 2009/0001101 | A1 | | 1/2009 | Zahradka et al. | |
| 2011/0204094 | A1 | | 8/2011 | Meckstroth et al. | |
| 2012/0015592 | A1 | | 1/2012 | Eliason | |
| 2012/0181345 | A1 | | 7/2012 | Mueller | |

OTHER PUBLICATIONS

International Search Report and Written Opinion issued on Sep. 1, 2014 in International Application No. PCT/US2014/035718.

International Search Report and Written Opinion issued in PCT/US2014/035717 on Aug. 21, 2014.

* cited by examiner

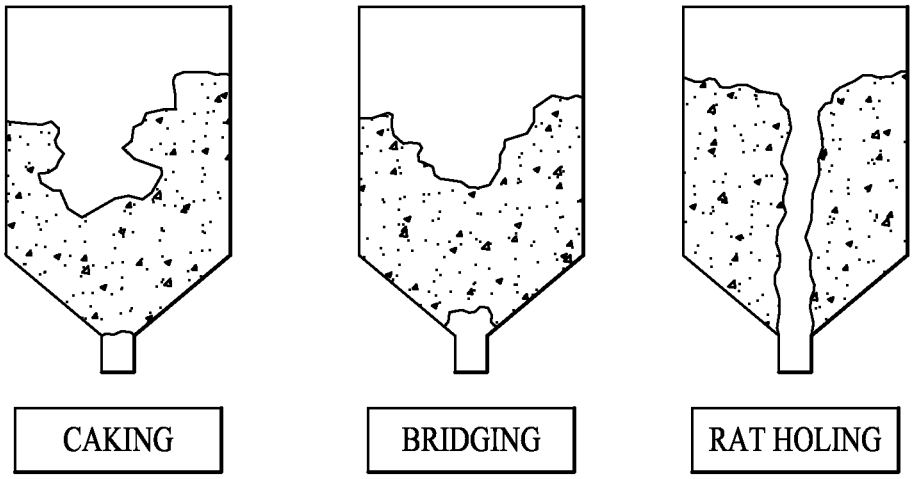
FIG. 1
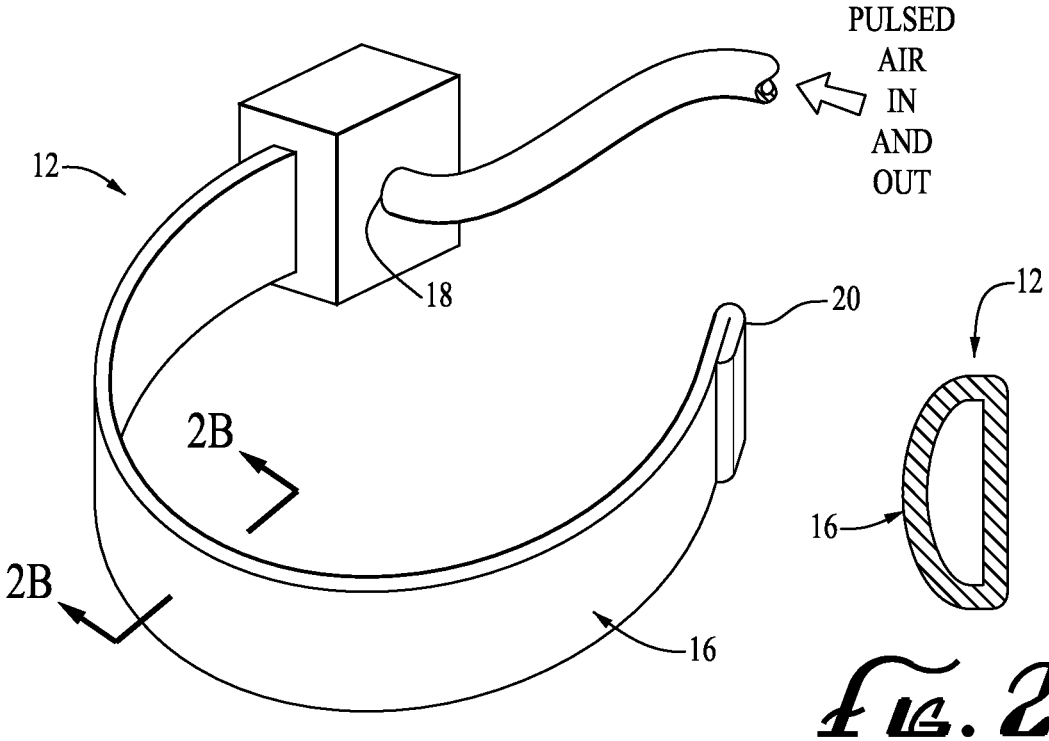
FIG. 2A
FIG. 2B

MICRO PARTICLE FLOW FACILITATOR

FIELD OF THE INVENTION

This invention relates generally to facilitating the flow of dry granular material, and, more specifically to, although not limited to, facilitating the flow of fine powders through a storage chamber exit orifice.

BACKGROUND OF THE INVENTION

Granular material is typically held in storage chambers until use. The ability of the material to flow through the exit orifice of the chamber depends in large part upon the particle size, shape and moisture content. The typical funnel shape of the storage chamber, along with gravity helps facilitate the flow of the material, and for most granular material that is enough. An excellent example of free-flowing material is sand. Fine powders, on the other hand, are much more resistant to flow due to their cohesive nature and/or bulk density and consequently need more than just the help of gravity to keep them flowing. An excellent example is baking flour, which is very resistant to flow and consequently needs the scraping action of a "flour sifter" to exit its chamber. In an effort to achieve a steady, even flow of material, the most common method of solving this flow problem is vibrating and/or pressurizing the entire storage chamber. However, there are still some powders that will not flow evenly, even with the use of vibration and air pressure. As a result, the phenomena of caking, bridging and rat holing are often seen in fine powders.

Referring now to FIG. 1, there is shown three prior art diagrams illustrating the phenomena of caking, bridging and rat holing that fine powders often exhibit. Caking occurs when a large amount of powder sticks to the sides of the chamber, and refuses to flow downward. Bridging occurs when the powder forms a bridge over the exit orifice, and effectively prevents the flow of material entirely. Rat holing occurs when a channel forms down the middle of the chamber, and a large amount of powder is left clinging to the sides of the chamber. In general, each of these three problems is seen at the entrance to the exit orifice.

Accordingly, there is a need for a flow facilitator that addresses the above-described problem phenomena often encountered at the entrance to the exit orifice.

SUMMARY OF THE INVENTION

The invention satisfies this need. In one aspect of the invention, the invention is a unique micro particle flow facilitator comprising: (a) a bourdon tube having a flexible duct capable of expanding and contracting in response to pulsations of a pressurized fluid, the duct being hollow, closed-ended and having an inlet port; and (b) a fluid pulsator for providing the pulsations of a pressurized fluid to the inlet port of the bourdon tube, the pulsator being in fluid-tight communication with the inlet port of the bourdon tube and having a fluid inlet port for connection to a source of pressurized fluid.

In another aspect of the invention, the invention is a flow distribution system for dispensing powders and other granular material. The system comprises the flow facilitator of the invention operatively disposed within a granular material dispensing chamber.

In a third aspect of the invention, the invention is a method for dispensing powders and other granular material using the flow distribution system of the invention.

DRAWINGS

These and other features, aspects and advantages of the present invention will become better understood with reference to the following description, appended claims, and accompanying drawings where:

FIG. 1 is a diagram of the common phenomena of caking, bridging and rat holing that fine powders often exhibit;

FIG. 2A is a diagram of a bourdon tube usable in the invention;

FIG. 2B is a cross-sectional view of the bourdon tube illustrated in FIG. 2A, taken along line AA;

DETAILED DESCRIPTION OF THE INVENTION

The following discussion describes in detail one embodiment of the invention and several variations of that embodiment. This discussion should not be construed, however, as limiting the invention to those particular embodiments. Practitioners skilled in the art will recognize numerous other embodiments as well.

Figure 4:
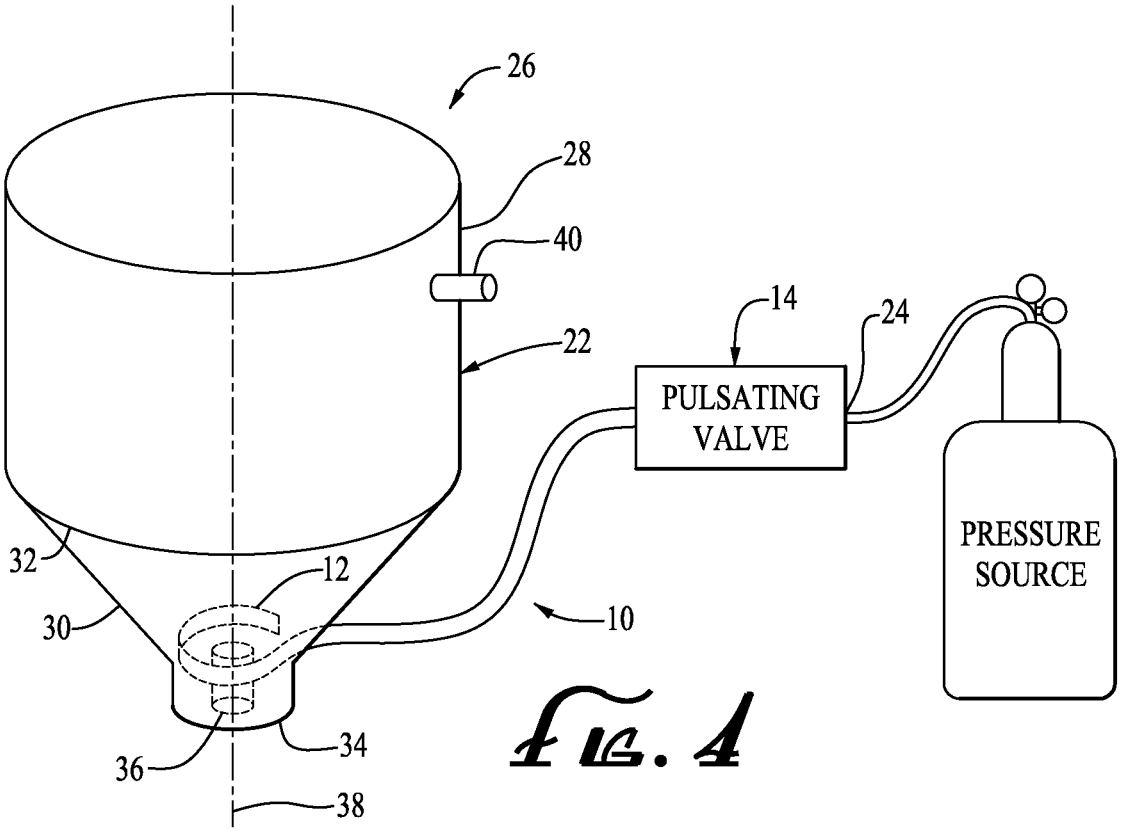
FIG. 4 is a diagram of a first micro particle flow facilitator having features of the invention.

In one aspect of the invention, the invention is a unique micro particle flow facilitator 10, illustrated for example in FIG. 4, comprising a bourdon tube 12 and a fluid pulsator 14.

A bourdon tube 12 useable in the invention is illustrated in FIG. 2A. The bourdon tube 12 comprises a flexible duct 16 capable of expanding and contracting in response to pulsations of a pressurized fluid, typically a pressurized gas such as pressurized air. The flexible duct 16 is hollow, closed-ended and has an inlet port 18.

Figure 3A:
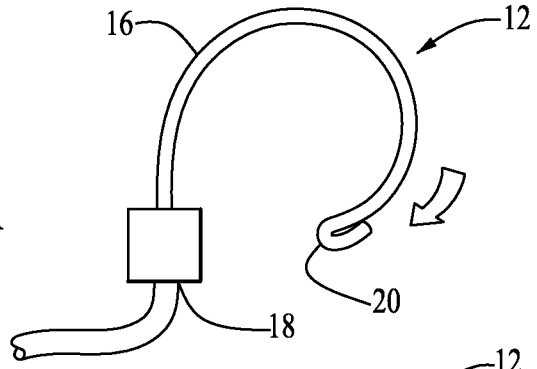
FIG. 3A is a diagram illustrating the furling of a bourdon tube.
Figure 3B:
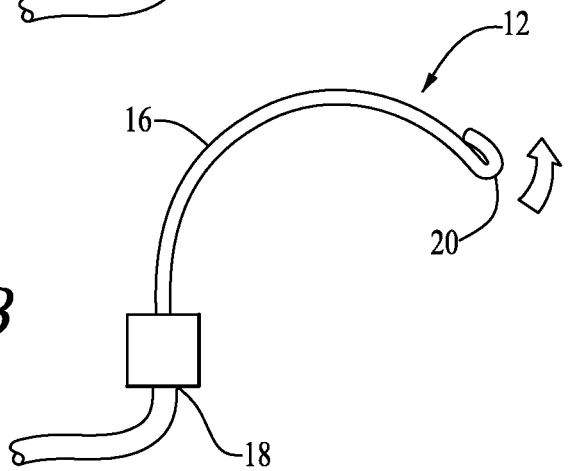
FIG. 3B is a diagram illustrating the unfurling of a bourdon tube.

The bourdon tube 12 is typically C-shaped and the flexible duct 16 is a flattened, curved tube (see FIG. 2B). When pressure is applied to the interior of the flexible duct 16, the expansion of the duct 16 tends to straighten out the duct 16. Accordingly, pulsating pressure applied to the duct 16 causes the duct 16 to alternatively unfurl (straighten) and furl (curl back to its normal C-shape). Rapid pressure pulsations can cause the closed end 20 of the duct 16 to vibrate. FIG. 3 illustrates the vibration, expansion and contraction motion of the bourdon tube 12. When the bourdon tube 12 is disposed within a granular material dispensing chamber 22, the alternating straightening and curling of the duct 16 continuously agitates granular material within the dispensing chamber 22, to thereby minimize material flow problems, such as caking, bridging and rat holing.

In one embodiment, the duct 16 of the bourdon tube 12 has an approximate diameter of 1.29 inches, and is made of beryllium copper. Other appropriate materials can also be used. In this bourdon tube 12 embodiment, the duct 16 has an approximate height of 0.38 inches.

The fluid pulsator 14 is used for providing the pulsations of a pressurized fluid to the inlet port 18 of the bourdon tube 12. The pulsator 14 is in fluid-tight communication with the inlet port 16 of the bourdon tube 12 and has a fluid inlet port 24 for connection to a source of pressurized fluid.

In a typical embodiment, the fluid pulsator 14 is a pulsating pneumatic valve which can be any of a wide variety of pulsating valves known to those of skill in the art. One such pulsating valve is an electronically controlled four port direct operated poppet solenoid valve Series VQD1000 sold by SMC Corporation of Tokyo, Japan.

Other forms of fluid pulsators 14 are also possible, including various mechanical pulsators. Possible mechanical pulsators 14 include (1) A rotary motion pulsator driving a cam against a bellows or piston connected to a hydraulic fluid filled tube or hose connected to the bourdon tube 12; (2) an electric motor driving a cam against bellows or piston connected to a hydraulic fluid filled tube or hose connected to the bourdon tube 12; and (3) an electric solenoid or linier motor driving against a bellows or piston connected to a hydraulic fluid filled tube or hose connected to the bourdon tube 12.

In another aspect of the invention, the invention is a flow distribution system 26 for dispensing powders and other granular material. The distribution system 26 comprises the flow facilitator 10 described above operatively disposed within a granular material dispensing chamber 22. As noted above, FIG. 4 illustrates a typical flow distribution system of the invention.

The dispensing chamber 22 has an upper portion 28, a lower portion 30, side walls 32 and a bottom 34. The bottom 34 defines an exit orifice 36. The dispensing chamber 22 has a vertical longitudinal central axis 38 disposed through the exit orifice 36.

The side walls 32 in the lower portion 30 of the dispensing chamber 22 typically converge toward the exit orifice 36. Most typically, the side walls 32 in the lower portion 30 of the dispensing chamber 22 terminate at the periphery of the exit orifice 36.

In some embodiments, the dispensing chamber 22 is enclosed such that the dispensing chamber 22 can be pressurized. In such embodiments, the dispensing chamber 22 further comprises a pressurizing connection 40 for attachment to a source of pressurized gas. Pressurizing the dispensing chamber 22 can frequently facilitate the downward flow of granular material through the dispensing chamber 22.

Figure 5A:
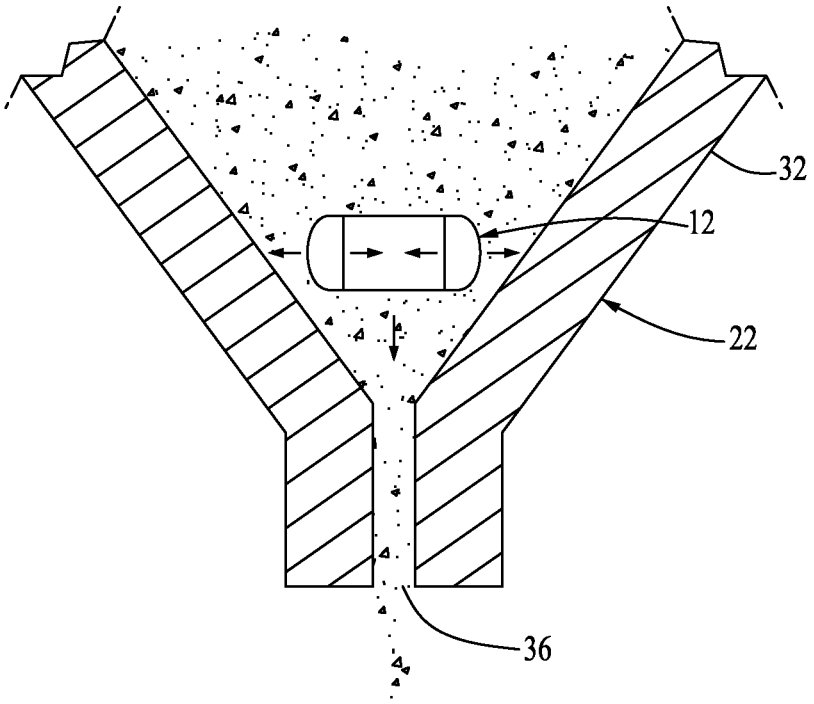
FIG. 5A is a first diagram of the furling/unfurling motion of a bourdon tube within a dispensing chamber.
Figure 5B:
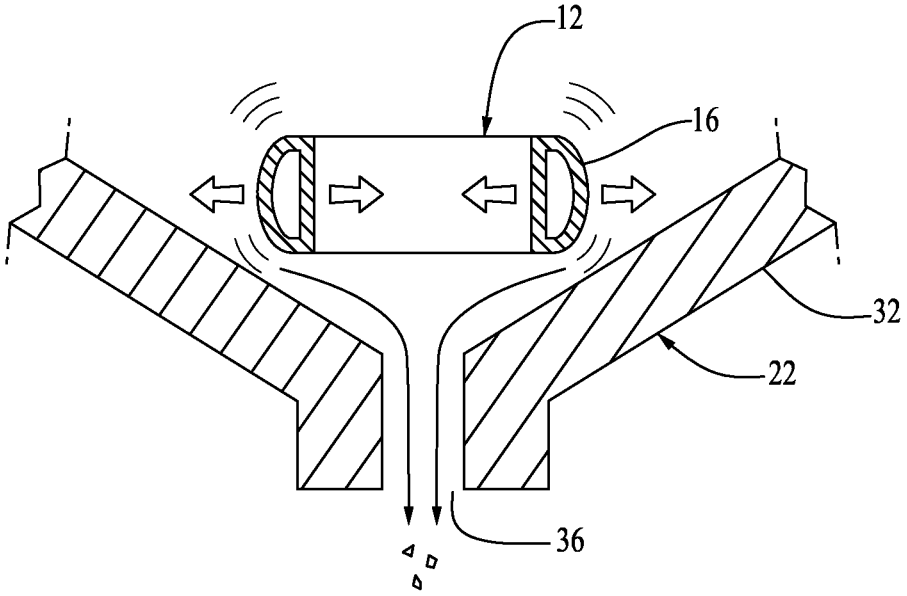
FIG. 5B is a second, more detailed diagram of the furling/unfurling motion of a bourdon tube within a dispensing chamber.

The bourdon tube 12 is typically disposed within the dispensing chamber 22 in a plane perpendicular to the central axis 38. Also, it is typical to dispose the bourdon tube 12 proximate to the side walls 32 in the lower portion 30 of the dispensing chamber 22. Where the bourdon tube 12 is C-shaped, the bourdon tube 12 is most typically disposed concentrically around the central axis 38 of the dispensing chamber 22, as illustrated in FIGS. 4, 5A and 5B.

Typically, but not necessarily, the fluid pulsator 14 is placed external to the dispensing chamber 22.

A third aspect of the invention is a method for dispensing powders and other granular material using the flow distribution system 26 of the invention. The method comprises the steps of:

(a) providing the flow distribution system 26 for dispensing powders and other granular material described above;

(b) connecting a source of pressurized fluid to the fluid inlet port 24 of the pulsating valve 14;

(c) placing the granular material into the dispensing chamber 22;

(d) controlling the flow of pressurized fluid with the fluid pulsator 14 to direct pulsations of pressurized fluid to the bourdon tube 12; and (e) dispensing the granular material from the dispensing chamber 22 via the exit orifice 36.

Figure 6:
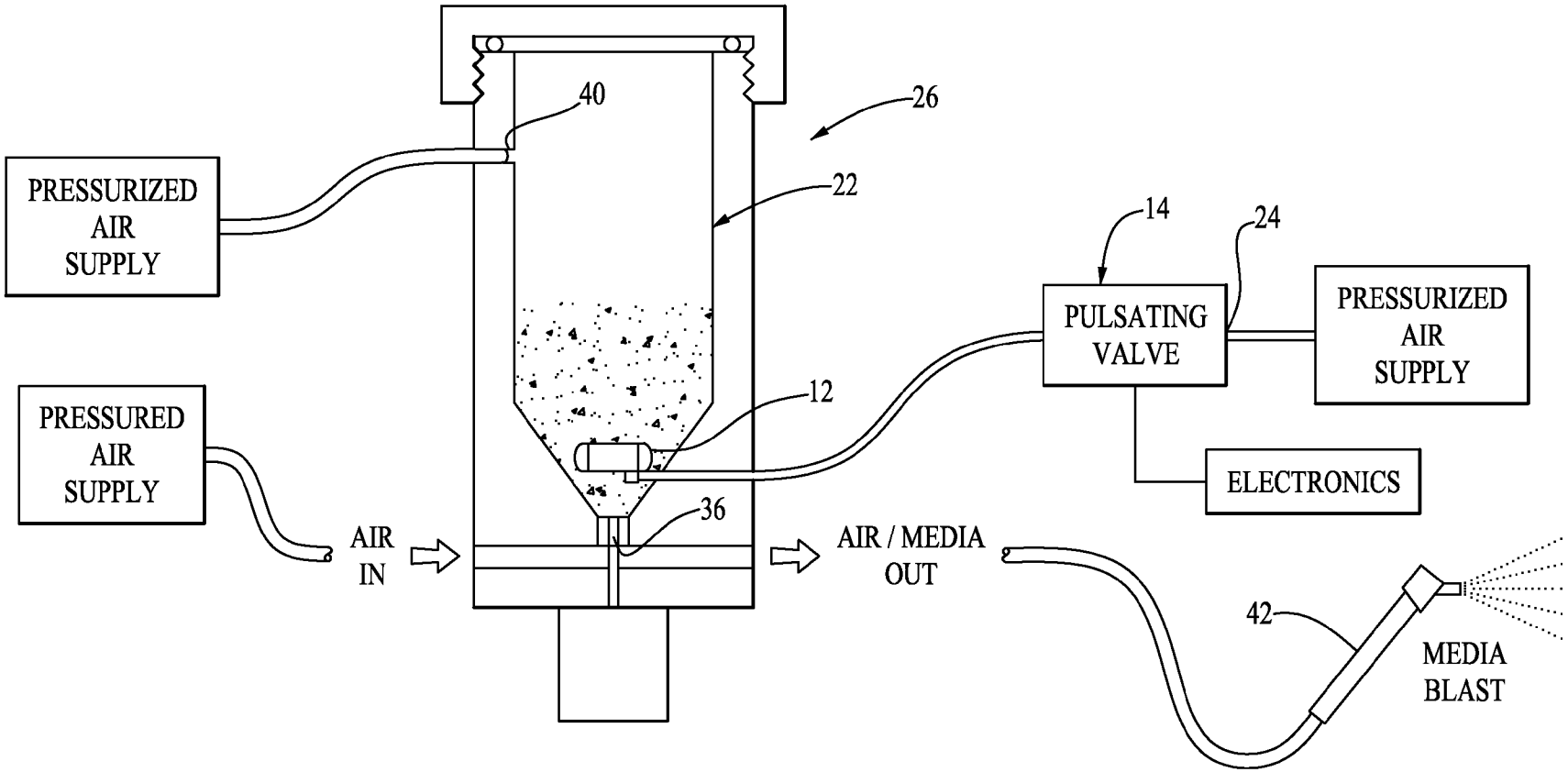
FIG. 6 is a diagram of a second micro particle flow facilitator having features of the invention.

FIG. 6 illustrates the method of the invention applied to the field of micro-sandblasting with abrasive powders and other surface conditioning media. The media is placed inside the pressurized dispensing chamber 22. The pulsating valve 14 with an inlet port 24 coupled to a pressured gas source, such as a pressurized air source, controls the movement of the bourdon tube 12 inside the pressurized dispensing chamber 22. The pressurized dispensing chamber 22 along with the bourdon tube 12 along with the movement of the bourdon tube 12 keeps the fine powder flowing steady as a second pressurized gas source carries the powder out and through a media blast nozzle 42.

Having thus described the invention, it should be apparent that numerous structural modifications and adaptations may be resorted to without departing from the scope and fair meaning of the instant invention as set forth herein above and described herein below by the claims.

What is claimed is:

1. A micro particle flow facilitator, comprising:

(a) a C-shaped flow facilitator tube having a flexible duct capable of expanding and contracting in response to pulsations of a pressurized fluid causing the duct to alternatively straighten and curl back to its normal C-shape, the duct being hollow, closed-ended and having an inlet port; and (b) a fluid pulsator for providing pulsations of the pressurized fluid to the inlet port of the facilitator tube, the pulsator being in fluid-tight communication with the inlet port of the tube and having a fluid inlet port for connection to a source of the pressurized fluid.

2. The flow facilitator of claim 1 wherein the fluid pulsator is a pulsating valve.

3. The flow facilitator of claim 1 wherein the facilitator tube is capable of vibrating in response to pulsations of the pressurized fluid.

4. A flow distribution system useful for dispensing powders and other granular material, the system comprising:

(a) a granular material dispensing chamber having an upper portion, a lower portion, side walls and a bottom, the bottom defining an exit orifice;

(b) a C-shaped flow facilitator tube disposed within the container proximate to the bottom of the dispensing chamber, the facilitator tube having a flexible duct capable of alternating from a straightened position and a C-shape curled position, the duct being hollow, closed-ended and having an inlet port, the facilitator tube being capable of expanding and contracting in response to pulsations of a pressurized fluid; and (c) a fluid pulsator for providing the flow of pressurized fluid to the inlet port of the facilitator tube, the pulsator being in fluid-tight communication with the inlet port of the tube and having a fluid inlet port for connection to a source of pressurized fluid and a fluid outlet port in fluid tight connection to the inlet port of the facilitator tube.

5. The system of claim 4 wherein the fluid pulsator is a pulsating valve.

6. The system of claim 4 wherein the facilitator tube is capable of vibrating in response to pulsations of the pressurized fluid.

7. The system of claim 4, wherein the side walls in the lower portion of the dispensing chamber converge toward the exit orifice.

8. The system of claim 4, wherein the side walls in the lower portion of the dispensing chamber terminate at the periphery of the exit opening.

9. The system of claim 8, wherein the dispensing chamber has a vertical longitudinal central axis disposed through the exit opening and the facilitator tube is disposed in a plane perpendicular to the central axis and proximate to the side walls in the lower portion of the dispensing chamber.

10. The system of claim 9 wherein the facilitator tube is disposed around the central axis of the dispensing chamber.

11. The system of claim 4, wherein the dispensing chamber is enclosed such that the dispensing chamber can be pressurized and the dispensing chamber further comprises a pressurizing connection for attachment to a source of pressurized gas.

12. A flow distribution system useful for dispensing powders and other granular material, the system comprising:

(a) a granular material dispensing chamber having an upper portion, a lower portion, side walls and a bottom, the bottom defining an exit orifice, the side walls in the lower portion of the dispensing chamber being convergent toward the exit orifice and terminating at the periphery of the exit orifice;

(b) a C-shaped flow facilitator tube disposed within the container proximate to the bottom of the dispensing chamber, the facilitator tube having a flexible duct capable of expanding and contracting, the duct being hollow, closed-ended and having an inlet port, the facilitator tube being capable of alternating from a straightened position to a C-shape curled position in response to pulsations of a pressurized fluid; and (c) a fluid pulsator for providing the flow of pressurized fluid to the inlet port of the facilitator tube, the pulsator being in fluid-tight communication with the inlet port of the facilitator tube and having a fluid inlet port for connection to a source of pressurized fluid and a fluid outlet port in fluid tight connection to the inlet port of the facilitator tube;

wherein the dispensing chamber has a vertical longitudinal central axis disposed through the exit opening; and wherein the facilitator tube is disposed around the central axis in a plane perpendicular to the central axis in the lower portion of the dispensing chamber.

13. The flow distribution system of claim 11 wherein the fluid pulsator is a pulsating valve.

14. A method for dispensing powders and other granular material comprising the steps of:

(a) providing a flow distribution system for dispensing powders and other granular material, the system comprising:

(i) a granular material dispensing chamber having an upper portion, a lower portion, side walls and a bottom, the bottom defining an exit orifice, the side walls in the lower portion of the dispensing chamber being convergent toward the exit orifice and terminating at the periphery of the exit orifice;

(ii) a C-shaped flow facilitator tube disposed within the container proximate to the bottom of the dispensing chamber, the facilitator tube having a flexible duct capable of alternating from a straightened position to a C-shape curled position, the duct being hollow, closed-ended and having an inlet port, the facilitator tube being capable of expanding, contracting and vibrating in response to pulsations of a pressurized fluid; and (iii) a fluid pulsator for providing the flow of pressurized fluid to the inlet port of the facilitator tube, the pulsator being in fluid-tight communication with the inlet port of the facilitator tube and having a fluid inlet port for connection to a source of pressurized fluid and a fluid outlet port in fluid tight connection to the inlet port of the facilitator tube;

wherein the dispensing chamber has a vertical longitudinal central axis disposed through the exit opening and wherein the facilitator tube is C-shaped and is disposed in the lower portion of the dispensing chamber around the central axis in a plane perpendicular to the central axis;

(b) connecting the source of pressurized fluid to the fluid inlet port of the pulsating valve;

(c) placing the granular material into the dispensing chamber;

(d) controlling the flow of pressurized fluid with the fluid pulsator to direct pulsations of pressurized fluid to the facilitator tube; and (e) dispensing the granular material from the dispensing chamber via the exit opening.

15. The method of claim 14 wherein the fluid pulsator is a pulsating valve.

16. The method of claim 14 wherein the controlling of the flow of pressurized fluid with the fluid pulsator in step (d) causes the facilitator tube to vibrate.

17. The method of claim 14 wherein the tube is a bourdon tube.

18. The micro particle flow facilitator of claim 1 wherein the tube is a bourdon tube.

19. The flow distribution system of claim 4 wherein the tube is a bourdon tube.

20. The flow distribution system of claim 12 wherein the tube is a bourdon tube.

* * * * *